US006254135B1

(12) United States Patent
Girard

(10) Patent No.: US 6,254,135 B1
(45) Date of Patent: Jul. 3, 2001

(54) ALBUM CONSTRUCTION FOR HOLDING AND DISPLAYING GREETING CARDS

(75) Inventor: Stefanie L. Girard, Burbank, CA (US)

(73) Assignee: Girard Design LLC, Sarasota, FL (US)

( * ) Notice: Subject to any disclaimer, the term of this patent is extended or adjusted under 35 U.S.C. 154(b) by 0 days.

(21) Appl. No.: 09/576,472

(22) Filed: May 23, 2000

(51) Int. Cl.[7] ..... B42D 1/00

(52) U.S. Cl. ..... 281/21.1; 281/15.1; 281/36; 281/46; 281/47

(58) Field of Search ..... 281/45, 47, 48, 281/21.1, 15.1, 36; 402/70, 73

(56) References Cited

U.S. PATENT DOCUMENTS

| | | | | |
|---|---|---|---|---|
| 71,703 | | 12/1867 | Clark . | |
| 104,415 | | 8/1870 | Boyrer . | |
| 234,987 | | 11/1880 | King . | |
| 730,727 | * | 6/1903 | Wolff | 281/48 |
| 902,112 | | 7/1908 | Goodyear . | |
| 936,223 | | 10/1909 | Dean . | |
| 1,217,625 | | 2/1917 | Osterhout . | |
| 1,430,335 | * | 9/1922 | Stengel | 281/48 |
| 2,336,214 | | 4/1943 | Bartels . | |
| 3,170,260 | | 2/1965 | Parker . | |
| 4,840,407 | | 6/1989 | Schroeder | 281/48 |
| 4,852,280 | | 8/1989 | Beattie | 40/124 |
| 5,096,227 | | 3/1992 | Pinkerton | 281/48 |
| 5,195,782 | | 3/1993 | Schroeder | 281/48 |
| 5,236,226 | * | 8/1993 | Sheffield | 281/48 |
| 5,265,914 | | 11/1993 | Russell | 281/42 |
| 5,573,276 | * | 11/1996 | Nomura et al. | 281/48 |

FOREIGN PATENT DOCUMENTS

| | | |
|---|---|---|
| 23017 | 10/1882 | (DE) . |
| 177949 | 6/1934 | (SE) . |

* cited by examiner

*Primary Examiner*—Willmon Fridie, Jr.
(74) *Attorney, Agent, or Firm*—William A. Simons; Jeffrey R. Ambroziak; Wiggins & Dana

(57) ABSTRACT

An album construction for holding and displaying printed folded cards comprising (a) a rectangular support having a center portion and two outer portions, said center portion being longitudinally shorter than the two outer portions and thereby forming two bounded slots at each end of the center portion; (b) an elastic cord having both ends attached to said rectangular support and being of sufficient length to encircle or wrap the center portion of the rectangular support at least twice and thereby produce a series of at least two taut elastic strands located immediately adjacent to each other whereby the fold of the printed cards may be held between one of the taut elastic cord materials and the rectangular support; and (c) an album cover having a central spine and two outer covers, said rectangular support affixed to the spine.

1 Claim, 2 Drawing Sheets

ALBUM CONSTRUCTION FOR HOLDING AND DISPLAYING GREETING CARDS

BACKGROUND OF THE INVENTION

1. Field of Invention

This present invention relates to an album construction for holding and displaying folded printed cards, particularly greeting cards.

2. Brief Description of the Art

During holidays or other special occasions, the exchange of greeting cards is a salutatory custom. Greeting cards form a tangible expression of well wishes from family and friends and are often accorded prominent placement atop tables, counters, mantels, and the like; however, they are all to often discarded within a short period of time. Even when not discarded, collections of greeting cards are often stacked and stored in such a manner as to render infrequent the enjoyment derived through retrieving and viewing their contents. In an attempt to provide a convenient manner of storage for greeting cards that both enables and encourages repeat viewing long after the passage of holiday seasons and events, several inventive techniques have been developed over the years. Many of these techniques involved the construction of a plurality of spaced-apart, side-by-side strands formed so that the folded card may be suspended or supported therefrom. Typical of these card and sheet paper holders may be found in U.S. Pat. Nos. 104,415; 104,863; 158,839; 308,295; 936,223; 3,789,526; 4,840,407; 4,852,280; and 5,573,276 and German Patent No. 23017 and Swiss Patent No. 177949.

While the aforementioned devices adequately retain the cards therein, there remain several problems inherent in many of their designs. Many of these card holding devices are both labor intensive and time consuming to produce. Because multiple individual elastic strands are mounted in a side-by-side manner, great care is required during the manufacturing process to assure proper alignment of the strands free of overlap. Typically, a central rectangular bar, core, or post member is provided to support the series of strands in a side-by-side relationship which is subsequently mounted to the spine of a folder. The ends of the strands were secured at each end of the bar, core or post member. This process is costly. In U.S. Pat. No. 5,573,276, the elastic strands were wrapped around an inner lining material which is then affixed to the folder. While cheaper to construct, this methodology is still costly and its assembly is somewhat complex. Specifically, this card holder requires both a full inner liner and an outer album cover that must be mated together in particular fashion. Such a requirement limits the ability to buy discreet parts of the device from the lowest cost provider and to assemble them in the most cost efficient manner.

What is needed then is a album for holding and displaying greeting cards that is aesthetically pleasing, consists of individual parts each of which may be produced quickly and cheaply, and whose parts can be assembled efficiently and interchangeably to produce marketable variations suitable to the needs and desires of the consumer.

BRIEF SUMMARY OF THE INVENTION

Accordingly, one aspect of the invention is directed to an album construction for holding and displaying printed, folded cards comprising:

(a) a rectangular support having a center portion and two outer portions, said center portion being longitudinally shorter than the two outer portions and thereby forming two bounded slots at each end of the center portion;

(b) an elastic cord having both ends attached to said rectangular support and being of sufficient length to encircle the center portion of the rectangular support at least twice and thereby produce a series of at least two taut elastic strands located immediately adjacent to each other whereby the fold of the printed cards may be held between one of the taut elastic strands and the rectangular support; and (c) an album cover having a central spine and two outer covers, said rectangular support affixed and bounded by to the spine.

The present invention advantageously allows a manufacturer to quickly assemble these low cost materials together. Furthermore, the rectangular support and elastic cord material may be easily assembled together at one location and then their combination can be easily shipped to another location where it is combined with the album cover. Moreover, the subassembly of rectangular support and elastic cord may be used with a wide variety of different album covers (e.g., covers having different written indicia on the cover).

The album construction allows people to make separate collections of cards based on a particular event (e.g., Christmas 1999) or by a particular person or persons who sent the cards. Also, this album construction makes easy viewing of both the inside and outside of a card.

DETAILED DESCRIPTION OF PREFERRED EMBODIMENT

Figure 1:
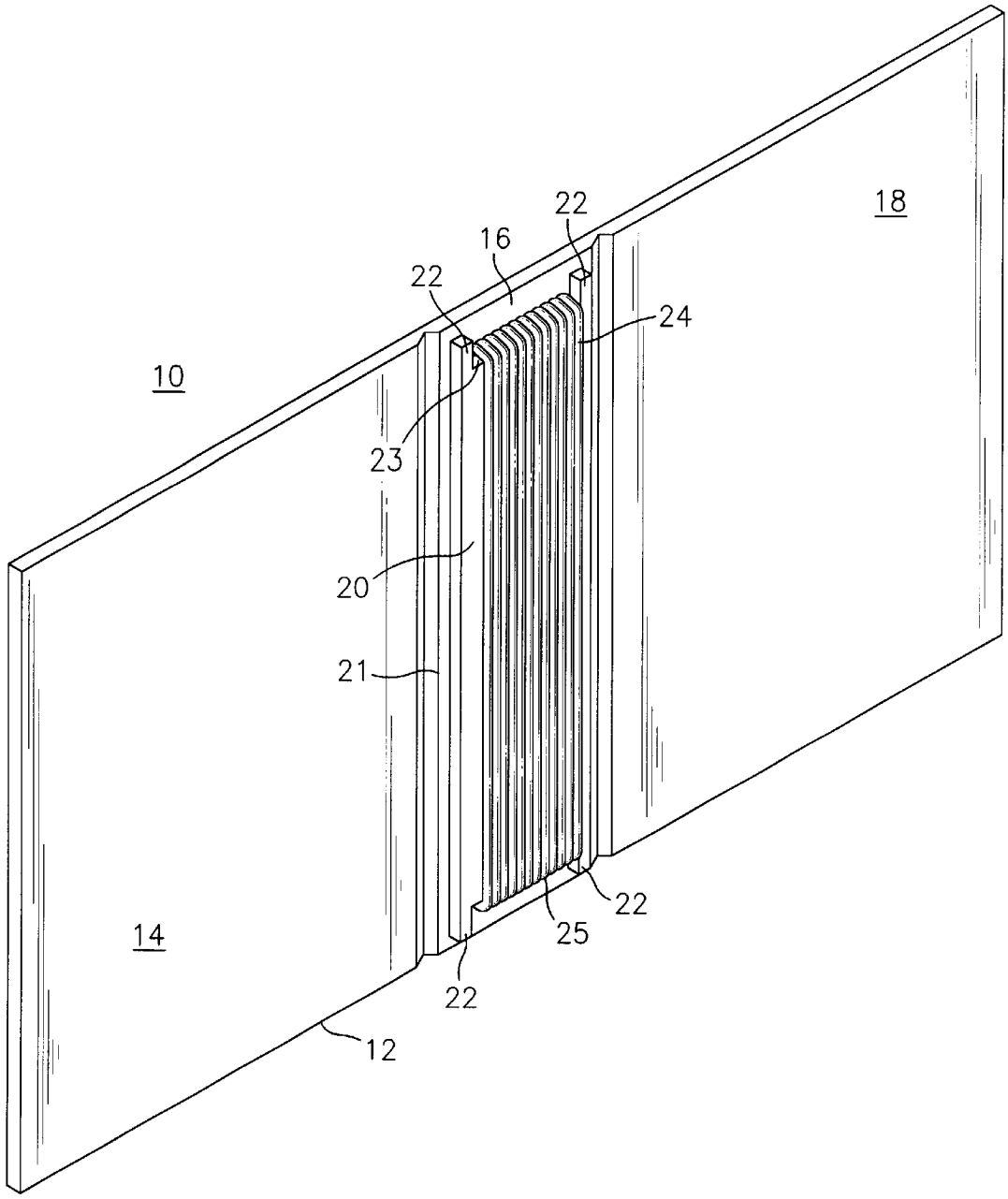
FIG. 1 is a perspective view of a greeting card holding and displaying album construction in accordance with the present invention.

Attention is now directed to FIG. 1 where a greeting card holding and displaying album construction 10 is illustrated. Briefly, album construction 10 includes a folder 12 having: a front panel 14, a rear panel 18, and a central spine portion 16. Folder 12 is suitably scored or manipulated in a longitudinal direction along the borders of abutment between either side of central spine portion 16 and the front panel 14 and rear panel 18 so as to allow the folding of the front and rear panels 14, 18 about the central spine portion 16. Attached to and bounded by the central spine portion 16 is a rectangular cord support 21 having: a central portion 23 and two outer portions 20. This rectangular support preferably has substantially the same height and width as the dimensions of the spine. The outer portions 20 longitudinally abut each side of central portion 23 extending equally both above and below the central portion 23. The extension of outer portions 20 above and below central portion 23 form four extension portions 22 which prevent the elastic cord material 24 from slipping off of the rectangular support 21. Rectangular support 21 forms a support around which an elastic cord material 24 may be longitudinally wound so as to form a plurality of side-by-side portions of elastic cord material 24. As detailed further in FIGS. 2–3, elastic cord material 24 is attached to the back side of rectangular support 21 at both end 30 and 31. Attachment of ends 30 and 31 to rectangular support 21 allows elastic cord material 24 to be repeatedly wound around central portion 23, bounded by extension portions 22, so as to provide a plurality of side-by-side portions of elastic cord material 24 numbering preferably between 5 and 50 side-by-side strands, more preferably between 20 and 40 side-by-side stands.

Elastic cord material 24 is preferably formed of a thermoplastic material, such as a plastic resin, providing limited flexibility or deflection in directions perpendicular to a longitudinal axis of each cord material. The cord materials only need to deflect a sufficient amount to slide the edge of the greeting card there through. More importantly, each strand is relatively inelastic in the longitudinal direction of the cord material so that after repeated use, each cord material will generally retain its original shape and length. This will assure resistance to sagging, as well as prevent permanent deformation or stretching in the longitudinal direction. One such plastic resin material may be provided by extruded low density polyethylene.

Elastic cord material 24 may be made of any suitable material capable of maintaining its elastic composition and function after a prolonged period of repose under the slight tension generated by winding elastic cord 24 around central portion 23 to create plurality of side-by-side portions of elastic cord 24 and after repeated stretching experienced when inserting printed card material. One example of suitable material out of which elastic cord 24 may be fashioned is that produced by Equality Specialties, Inc. of Chicago, Ill. The total length of the cord material 24 will depend upon the desired number of strands 25 and the desired height of the card album. For example, a card album having a 8 inch height and 25 to 40 strands will require cord material of about 300 to 400 inches long.

Figure 2:
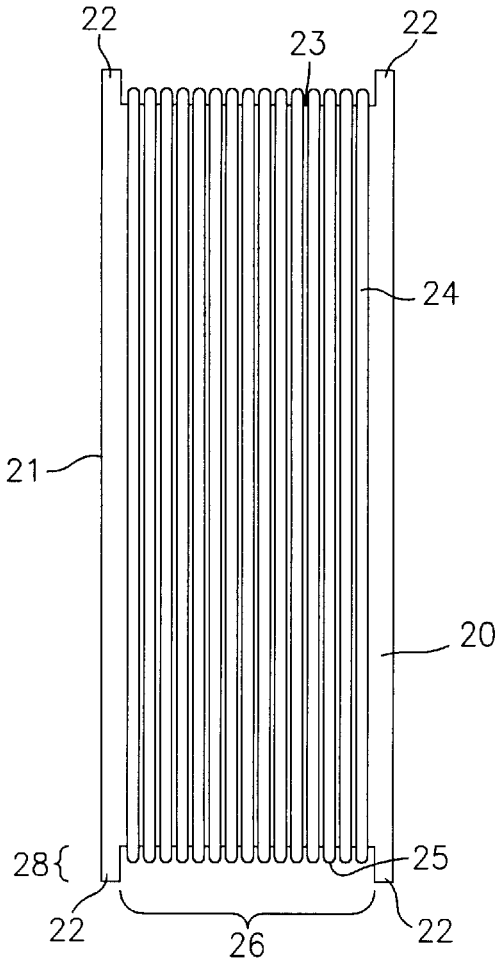
FIG. 2 is a schematic representation of the front side of a rectangular support around which is wound an elastic strand in accordance with the present invention.
Figure 3:
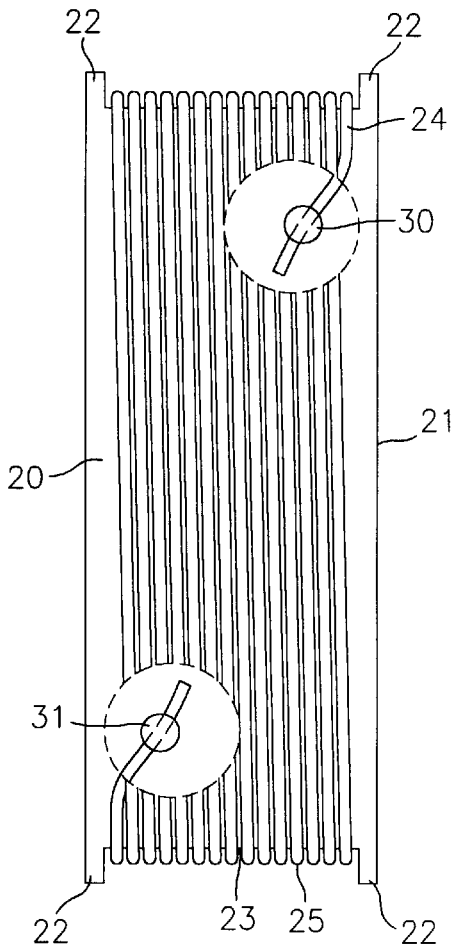
FIG. 3 is a schematic representation of the back side of a rectangular support around which is wound an elastic cord material in accordance with the present invention.

Directing attention to FIGS. 2–3, FIG. 2 shows the front side of rectangular support 21 around which is wound elastic strand 24 forming a plurality of side-by-side elastic cord material 25 into which greeting cards or other suitable materials may be inserted and bound. Extension portions 22 are created during the production process by stamping out a rectangular portion of adjacent rectangular support 21 sections of a width 26 and a height equal to twice that of height 28. The rectangular area stamped out is twice height 28 because half of the stamped area forms the top of one rectangular support 21 while the other half forms the bottom of the adjacent rectangular support 21 being produced. Preferably, the height 28 is between 0.05 and 0.25 inches; more preferably, 0.167 inches. The resultant extension portions 22 extend beyond the top and bottom of central portion 23 and prevent elastic strand 24 from slipping off of rectangular support 21. Rectangular support 21 may be fashioned of any material capable of maintaining each of the plurality of side-by-side portions of elastic strand 24 under a tension suitable to retain inserted printed material without folding or bending. Possible materials of which to construct rectangular support 21 include 100 point board and polyethylene.

FIG. 3 illustrates the back side of rectangular support 21 onto which is attached both ends 30 and 31 of elastic strand 24. Attachment of elastic strand 24 to rectangular support 21 may be accomplished by any suitable method including, but not limited to, hot gluing or administering an adhesive material. Many such methods of attaching an elastic strand 24 to a rectangular support 21 will prove obvious to one skilled in the art of manufacturing such articles and the embodiment described herein is intended to broadly encompass all such methodologies.

In one embodiment of the present invention many rectangular cord supports 21 are individually wrapped with a sufficient amount of cord material 24 and both ends of cord material 24 are affixed to one side of each cord support 21. The tautness of the cords should be such to ensure that a folded card can slip under and be held by each strand 25.

These wrapped cord supports are then affixed to the spines by applying hot glue to either or both the spine and back of the rectangular support and then contacting them together. The affixing may also be carried out by any other standard affixing means including both chemical adhesives or mechanical means of affixing such as tape, staples or other conventional means.

While the present invention has been described with reference to a specific embodiment, the description is illustrative of the invention and is not to be construed as limiting the invention. Various modifications to the present invention can be made to the preferred embodiments by those skilled in the art without departing from the spirit and scope of the invention as defined by the appended claims. All patents, patent applications and publications referred to in this application are incorporated herein by reference in their entirety.

What is claimed is:

1. An album construction for holding and displaying printed, folded cards comprising:

(a) a rectangular support having a center portion and two outer portions, said center portion being longitudinally shorter than the two outer portions and thereby forming two bounded slots at each end of the center portion;

(b) an elastic cord having both ends attached to said rectangular support and being of sufficient length to encircle the center portion of the rectangular support at least twice and thereby produce a series of at least two taut elastic strands located immediately adjacent to each other whereby the fold of the printed cards may be held between one of the taut elastic cord materials and the rectangular support; and (c) an album cover having a central spine and two outer covers, said rectangular support affixed and bounded by the spine.

* * * * *